US008998011B2

(12) United States Patent
Zhu

(10) Patent No.: US 8,998,011 B2
(45) Date of Patent: Apr. 7, 2015

(54) COLLAPSIBLE RACK

(71) Applicant: Shou Qiang Zhu, Ontario, CA (US)

(72) Inventor: Shou Qiang Zhu, Ontario, CA (US)

(73) Assignee: IP Power Holding Limited, Hong Kong (CN)

( * ) Notice: Subject to any disclaimer, the term of this patent is extended or adjusted under 35 U.S.C. 154(b) by 0 days.

(21) Appl. No.: 14/327,552

(22) Filed: Jul. 9, 2014

(65) Prior Publication Data

US 2015/0014265 A1 Jan. 15, 2015

Related U.S. Application Data

(60) Provisional application No. 61/844,037, filed on Jul. 9, 2013.

(51) Int. Cl.

| | |
|---|---|
| ***A47B 43/00*** | (2006.01) |
| ***A47B 47/00*** | (2006.01) |
| ***A47B 57/00*** | (2006.01) |
| ***B65D 6/00*** | (2006.01) |
| ***B65D 8/14*** | (2006.01) |
| ***A47B 43/04*** | (2006.01) |
| ***A47F 5/10*** | (2006.01) |
| ***A47B 87/02*** | (2006.01) |
| *A47B 67/04* | (2006.01) |

(52) U.S. Cl.

CPC . *A47B 43/04* (2013.01); *A47F 5/10* (2013.01); *A47B 67/04* (2013.01); *A47B 87/0292* (2013.01)

(58) Field of Classification Search

CPC ..... A47B 43/00; A47B 43/04; A47B 67/04; A47B 43/003; A47F 5/10; B65D 7/26; B65D 7/32

USPC ..... 312/6, 258, 33.1, 237; 220/1.5, 6, 7; 211/182, 41.5, 41.6, 200–201, 204

See application file for complete search history.

(56) References Cited

U.S. PATENT DOCUMENTS

| | | | | | |
|---|---|---|---|---|---|
| 1,394,007 | A | * | 10/1921 | Hall | 312/6 |
| 2,340,540 | A | * | 2/1944 | Lange | 211/1.3 |
| 2,748,955 | A | * | 6/1956 | Anselmo | 211/204 |
| 3,223,274 | A | * | 12/1965 | Tolnai | 220/7 |
| 3,456,829 | A | * | 7/1969 | Glassmeyer | 220/1.5 |
| 3,602,388 | A | * | 8/1971 | Hurkamp | 220/1.5 |
| 3,760,943 | A | * | 9/1973 | Reader | 209/546 |
| 4,214,669 | A | * | 7/1980 | McQuiston | 220/6 |
| 4,684,034 | A | * | 8/1987 | Ono et al. | 220/6 |
| 4,735,320 | A | * | 4/1988 | Hoss | 206/583 |
| 5,190,179 | A | * | 3/1993 | Richter et al. | 220/6 |

(Continued)

*Primary Examiner* — Daniel J Troy
*Assistant Examiner* — Kimberley S Wright
(74) *Attorney, Agent, or Firm* — Che-Yang Chen; Law Office of Michael Chen

(57) ABSTRACT

A collapsible rack is disclosed. In one embodiment, a collapsible rack has a first supporting member, a second supporting member, a first connecting member and a second connecting member. The first supporting member may include a first pair of supporting rods, a second pair of supporting rods and a first supporting fabric. The first pair of supporting rods are parallel and spaced with a predetermined distance, as well as the second pair supporting rods. The first pair of supporting rods and the second pair of supporting rods are connected to form a rectangular surface and the first supporting fabric is secured. The structure of the second supporting member is substantially identical to the first supporting member, and the first and second supporting members are parallel, spaced with a predetermined distance and connected by the first and second connecting members.

11 Claims, 7 Drawing Sheets

(56) References Cited

U.S. PATENT DOCUMENTS

| | | | | | |
|---|---|---|---|---|---|
| 5,560,502 | A * | 10/1996 | Hsiung | 211/195 |
| 5,573,027 | A * | 11/1996 | Hsiung | 135/142 |
| 5,678,904 | A * | 10/1997 | Hung | 312/3 |
| D389,344 | S * | 1/1998 | Kun-Tang | D6/476 |
| 6,062,410 | A * | 5/2000 | Bradford et al. | 220/6 |
| D429,091 | S * | 8/2000 | Chen | D6/461 |
| D431,392 | S * | 10/2000 | Felsenthal | D6/445 |
| D433,252 | S * | 11/2000 | Chen | D6/478 |
| 6,142,589 | A * | 11/2000 | Wang | 312/6 |
| D435,364 | S * | 12/2000 | Felsenthal | D6/446 |
| D435,990 | S * | 1/2001 | Felsenthal | D6/514 |
| 6,601,928 | B1 * | 8/2003 | Kortman et al. | 312/3 |
| 6,604,897 | B2 * | 8/2003 | Yeomans | 410/32 |
| 6,799,594 | B2 * | 10/2004 | Kuo | 135/147 |
| 7,762,417 | B2 * | 7/2010 | Arnold | 220/6 |
| 7,878,345 | B2 * | 2/2011 | Tourlamain | 211/195 |
| 8,047,391 | B2 * | 11/2011 | Lu | 220/9.4 |
| 8,453,854 | B2 * | 6/2013 | Baran et al. | 211/201 |
| 8,459,473 | B2 * | 6/2013 | Wang | 211/118 |
| 8,573,433 | B2 * | 11/2013 | Kochanowski | 220/666 |
| 8,851,753 | B1 * | 10/2014 | Belser | 383/22 |
| 2004/0232146 | A1 * | 11/2004 | Kessler et al. | 220/6 |
| 2006/0261061 | A1 * | 11/2006 | Spindel et al. | 220/6 |
| 2007/0126317 | A1 * | 6/2007 | Liu | 312/6 |
| 2007/0200470 | A1 * | 8/2007 | Wang | 312/6 |
| 2008/0073301 | A1 * | 3/2008 | Van Conkelberge | 211/104 |
| 2008/0174214 | A1 * | 7/2008 | Segall et al. | 312/6 |
| 2008/0210687 | A1 * | 9/2008 | Clive-Smith | 220/1.5 |

* cited by examiner

COLLAPSIBLE RACK

CROSS-REFERENCE TO RELATED APPLICATIONS

This application claims priority under 35 U.S.C. §119(e) to U.S. Provisional Patent Application Ser. No. 61/844,037, filed on Jul. 9, 2013, the entire contents of which are hereby incorporated by reference.

FIELD OF THE INVENTION

The present invention relates generally to a rack for storage purposes, and more particularly to a portable, adjustable and collapsible rack.

BACKGROUND OF THE INVENTION

Equipment may be stored or held in a variety of ways. For example, some equipment may be packed in boxes, other equipment may be carried in bags, while still other equipment may be hung on or even stood up against another object. Oftentimes, the apparatus used to store or hold equipment may be chosen based on the equipment itself as well as how a person handling the equipment decides to organize such equipment.

One apparatus that is commonly used to organize equipment is a rack. Conventional racks are typically designed to allow equipment to hang from the rack or to be placed up against or into the rack. However, many such racks are often also designed to be affixed to another structure or are large and awkward. Taking conventional racks to places where they could be used to hold equipment, therefore, may be undesirable. Therefore, there remains a need for a new and improved rack that is collapsible, portable, light weight, and easy to set up to overcome the problems stated above.

SUMMARY OF THE INVENTION

It is an object of the present invention to provide a collapsible rack that is portable and easy to set up because the size of collapsible rack can be significantly reduced.

It is another object of the present invention to provide a collapsible rack that can be stacked with at least one other collapsible rack to increase the storing capability.

It is a further object of the present invention to provide a collapsible rack having a receiving space that can be divided into a plurality of small compartments to fulfill different storage purposes.

In one embodiment, a collapsible rack has a first supporting member, a second supporting member, a first connecting member and a second connecting member. The first supporting member may include a first pair of supporting rods, a second pair of supporting rods and a first supporting fabric. The first pair of supporting rods are substantially parallel and spaced with a predetermined distance, as well as the second pair supporting rods. In one embodiment, the predetermined distance between the first pair of supporting rods is substantially equal to the length of the second pair of supporting rods, while the predetermined distance between the second pair of the supporting rods is substantially equal to the length of the first pair of supporting rods. Namely, the first pair of supporting rods and the second pair of supporting rods define a substantially rectangular surface, and the first supporting fabric is secured thereon. Furthermore, the first pair of supporting rods and the second pair of supporting rods are connected with each other through a plurality of connectors. The structure of the second supporting member is substantially identical to the first supporting member.

The first connecting member may include a plurality of connecting rods, a holding rod, a first central connector, and a second central connector. One end of each connecting rods is pivotally connected to one of the connectors, and the other end thereof is pivotally connected to one of the central connectors. For example, one end of the connecting rod is connected to the connector, and the other end thereof is connected to the second central connector. The holding rod is secured between two central connectors, and a third supporting fabric is secured by the first connecting member. It is noted that the holding rod is substantially parallel and spaced with the supporting rods. The structure of the second connecting member is substantially identical to the first connecting member.

In an exemplary embodiment, the first supporting members and the second supporting members are disposed in a parallel manner, and spaced and connected by the first connecting member and second connecting member to define a receiving space. The receiving space can be divided into a plurality of smaller compartments by an inner fabric, and the inner fabric can be secured by and between the first and second supporting members, and the first and second connecting members.

The collapsible rack in the present invention is portable and can be carried from the holding rod, and the size of the rack can be significantly reduced by simply pushing down the holding rods. More specifically, when the holding rod is pushed down, the first and second central connectors and are simultaneously moved down with the holding rod to further change the configuration of the connecting rods and from linear to V-shaped to collapse the third supporting fabric and at least a portion of the inner fabric in the receiving space. Similarly, the holding rod can be pushed down to collapse the fourth supporting fabric and at least a portion of the inner fabric in the receiving space to totally collapse the rack. It is noted that each V-shaped configuration (including a central connector coupled with two connecting rods) can be received between the first supporting member and the second supporting member, so the size of the collapsible rack is significantly reduced. It is also noted that the thickness of the collapsible rack is approximately the length of the central connector.

DETAILED DESCRIPTION OF THE INVENTION

The detailed description set forth below is intended as a description of the presently exemplary device provided in accordance with aspects of the present invention and is not intended to represent the only forms in which the present invention may be prepared or utilized. It is to be understood, rather, that the same or equivalent functions and components may be accomplished by different embodiments that are also intended to be encompassed within the spirit and scope of the invention.

Unless defined otherwise, all technical and scientific terms used herein have the same meaning as commonly understood to one of ordinary skill in the art to which this invention belongs. Although any methods, devices and materials similar or equivalent to those described can be used in the practice or testing of the invention, the exemplary methods, devices and materials are now described.

All publications mentioned are incorporated by reference for the purpose of describing and disclosing, for example, the designs and methodologies that are described in the publications that might be used in connection with the presently described invention. The publications listed or discussed above, below and throughout the text are provided solely for their disclosure prior to the filing date of the present application. Nothing herein is to be construed as an admission that the inventors are not entitled to antedate such disclosure by virtue of prior invention.

Figure 1:
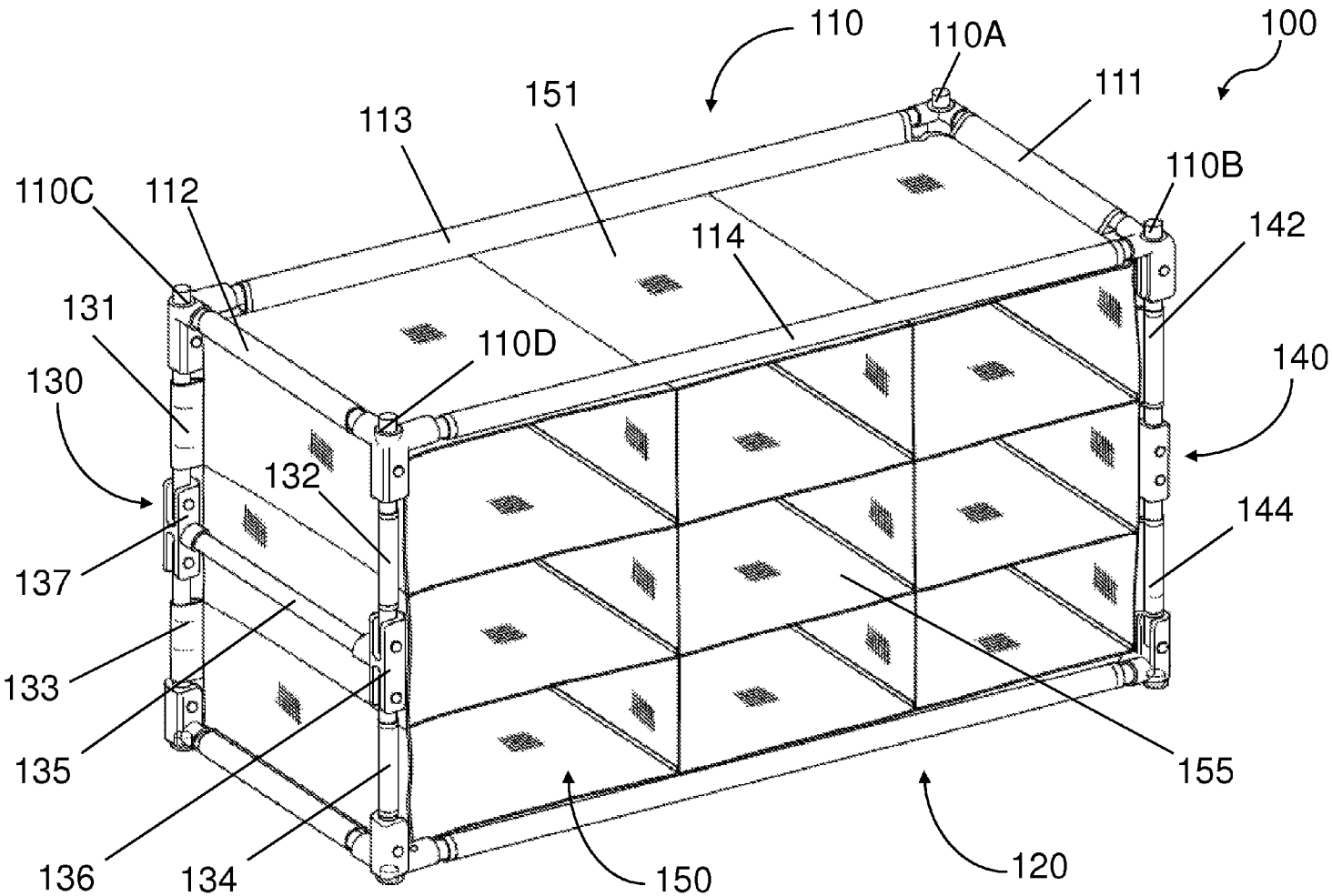
FIGS. 1 and 1*a* illustrate a schematic view of the collapsible rack in the present invention.

In order to further understand the goal, characteristics and effect of the present invention, a number of embodiments along with the drawings are illustrated as following:

Referring to FIG. 1, a collapsible rack 100 has a first supporting member 110, a second supporting member 120, a first connecting member 130 and a second connecting member 140. The first supporting member 110 may include a first pair of supporting rods (111, 112), a second pair of supporting rods (113, 114) and a first supporting fabric 151. The first pair of supporting rods (111, 112) are substantially parallel and spaced with a predetermined distance, as well as the second pair supporting rods (113, 114). In one embodiment, the predetermined distance between the first pair of supporting rods (111, 112) is substantially equal to the length of the second pair of supporting rods (113, 114), while the predetermined distance between the second pair of the supporting rods (113, 114) is substantially equal to the length of the first pair of supporting rods (111, 112). Namely, the first pair of supporting rods (111, 112) and the second pair of supporting rods (113, 114) define a substantially rectangular surface, and the first supporting fabric 151 is secured thereon. Furthermore, the first pair of supporting rods (111, 112) and the second pair of supporting rods (113, 114) are connected with each other through a plurality of connectors (110A, 110B, 110C, 110D).

Figure 1A:
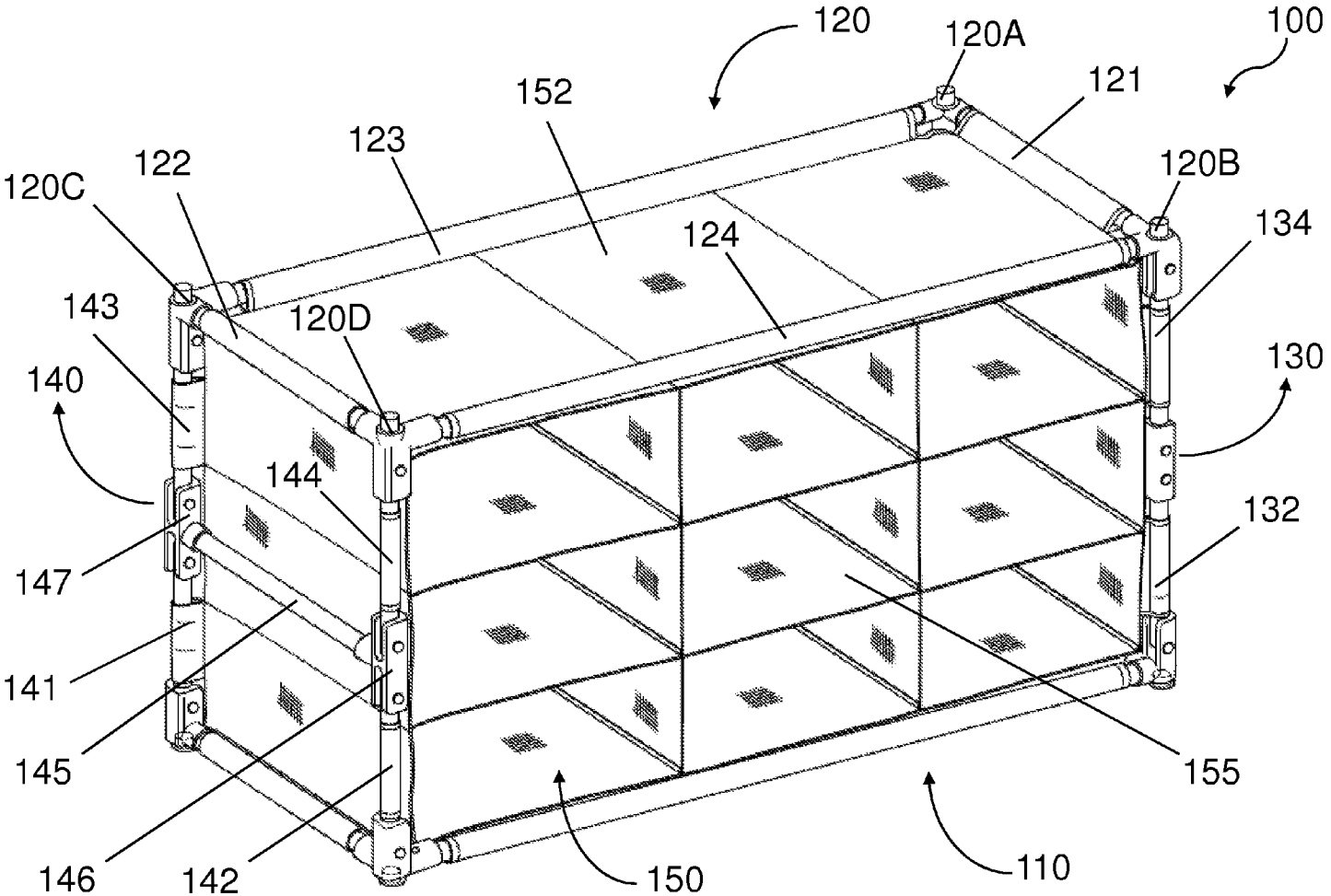

The structure of the second supporting member 120 is substantially identical to the first supporting member 110, as shown in FIG. 1*a*. The second supporting member 120 may include a first pair of supporting rods (121, 122), a second pair of supporting rods (123, 124) and a second supporting fabric 152. The first pair of supporting rods (121, 122) are substantially parallel and spaced with a predetermined distance, as well as the second pair supporting rods (123, 124). In one embodiment, the predetermined distance between the first pair of supporting rods (121, 122) is substantially equal to the length of the second pair of supporting rods (123, 124), while the predetermined distance between the second pair of the supporting rods (123, 124) is substantially equal to the length of the first pair of supporting rods (121, 122). Namely, the first pair of supporting rods (121, 122) and the second pair of supporting rods (123, 124) form a substantially rectangular surface, and the second supporting fabric 152 is secured thereon. Furthermore, the first pair of supporting rods (121, 122) and the second pair of supporting rods (123, 124) are connected with each other through a plurality of connectors (120A, 120B, 120C, 120D).

The first connecting member 130 may include a plurality of connecting rods (131, 132, 133, 134), a holding rod 135, a first central connector 136, and a second central connector 137. One end of each connecting rods is pivotally connected to one of the connectors (110A, 110B, 110C, 110D), and the other end thereof is pivotally connected to one of the central connectors (136, 137). For example, one end of the connecting rod 131 is connected to the connector 110C, and the other end thereof is connected to the second central connector 137. The holding rod 135 is secured between two central connectors (136, 137), and a third supporting fabric 153 is secured by the first connecting member 130. It is noted that the holding rod 135 is substantially parallel and spaced with the supporting rods 112 and 121.

The structure of the second connecting member 140 is substantially identical to the first connecting member 130 (as shown in FIG. 1*a*). The second connecting member 140 may include a plurality of connecting rods (141, 142, 143, 144), a holding rod 145, a first central connector 146, and a second central connector 147. One end of each connecting rods is pivotally connected to one of the connectors (120A, 120B, 120C, 120D), and the other end thereof is pivotally connected to one of the central connectors (146, 147). For example, one end of the connecting rod 141 is connected to the connector 110A, and the other end thereof is connected to the second central connector 147. The holding rod 145 is secured between two central connectors (146, 147), and a fourth supporting fabric 154 is secured by the second connecting member 140. It is noted that the holding rod 145 is substantially parallel and spaced with the supporting rods 111 and 122.

In an exemplary embodiment, the first supporting members 110 and the second supporting members 120 are disposed in a parallel manner, and spaced and connected by the first connecting member 130 and second connecting member 140 to define a receiving space 150, as shown in FIGS. 1 and 1*a*. The receiving space 150 can be further divided into a plurality of smaller compartments by an inner fabric 155, and the inner fabric 155 can be secured by and between the first and second supporting members (110, 120), and the first and second connecting members (130, 140).

Figure 2:
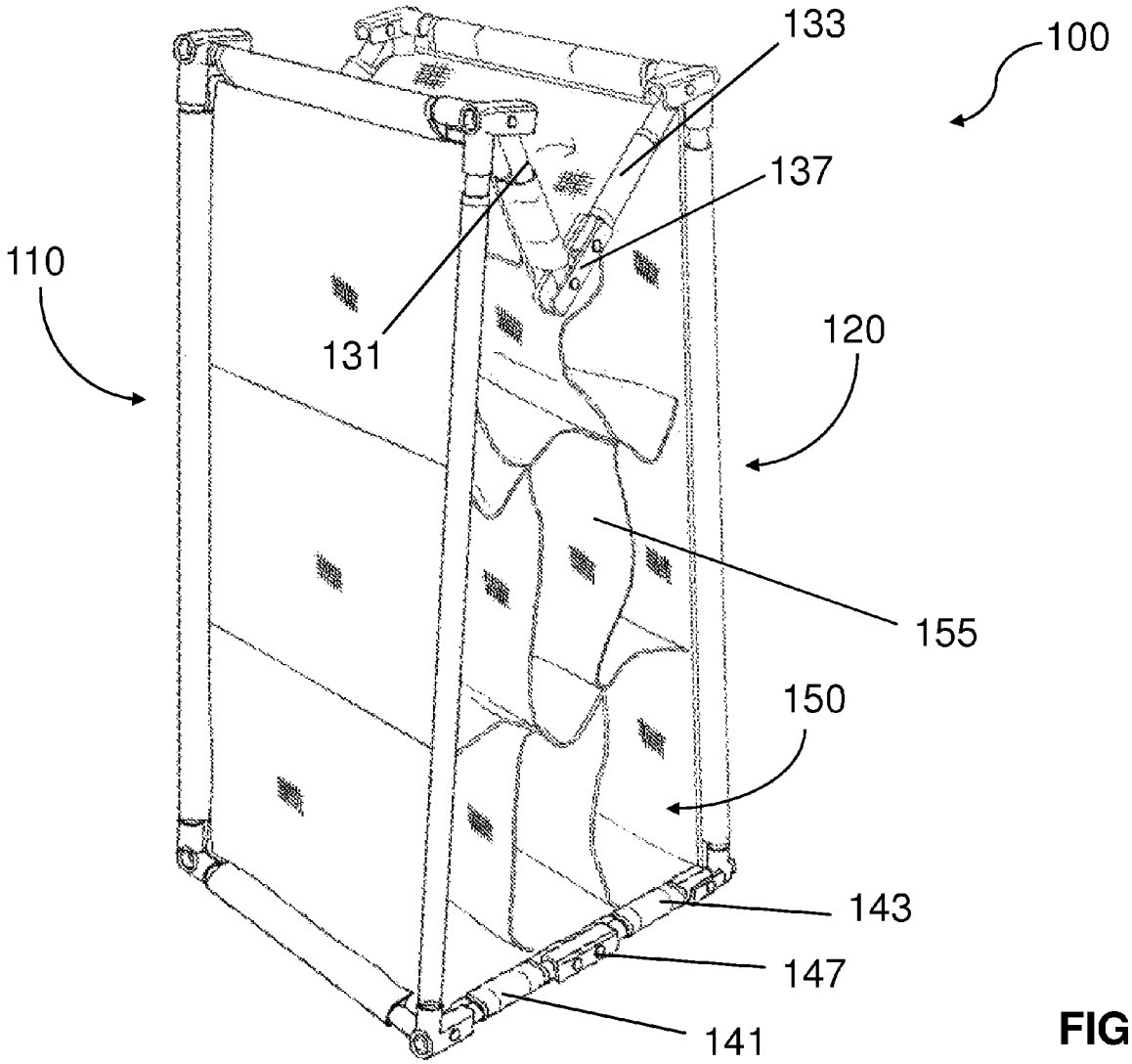
FIG. 2 illustrates a schematic view of the collapsible rack when one of the holding rods is pushed down to start the collapsing process.
Figure 3:
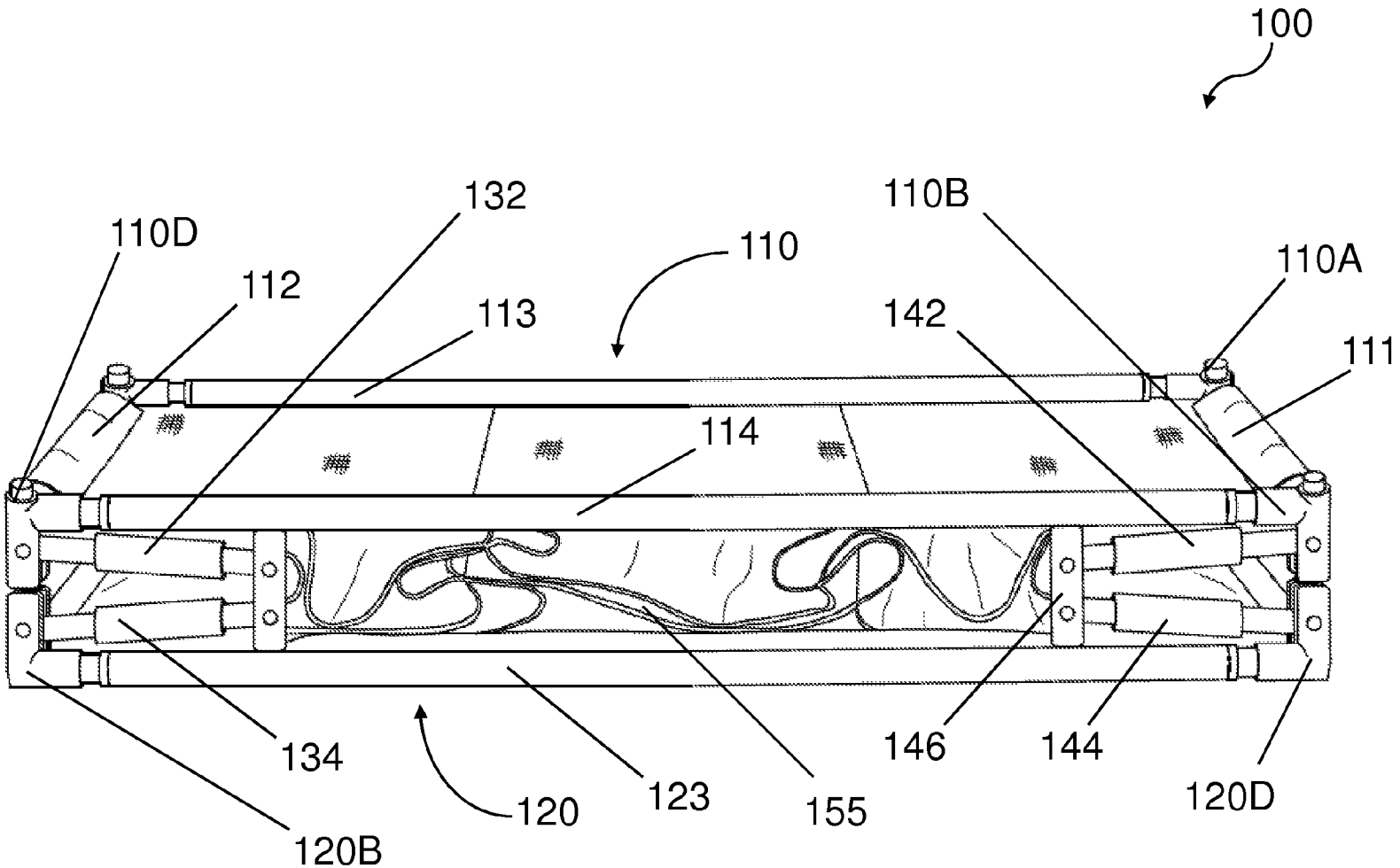
FIG. 3 illustrates a schematic view of the collapsible rack in the present invention when the rack is totally collapsed.

The collapsible rack 100 in the present invention is portable and can be carried from the holding rod 135 (or 145), and the size of the rack 100 can be significantly reduced by simply pushing down the holding rods 135 and 145. More specifically, when the holding rod 135 is pushed toward the direction of the receiving space 150, the first and second central connectors 136 and 137 are simultaneously moved down with the holding rod 135 to further change the configuration of the connecting rods (131, 133) and (132, 134) from linear to V-shaped to collapse the third supporting fabric 153 and at least a portion of the inner fabric 155 in the receiving space 150, as shown in FIGS. 1 and 2. Similarly, the holding rod 145 can be pushed toward the receiving space 150 to collapse the fourth supporting fabric 154 and at least a portion of the inner fabric 155 in the receiving space 150 to totally collapse the rack 100 as shown in FIG. 3. It is noted that each V-shaped configuration (including a central connector coupled with two connecting rods) can be received between the first supporting member 110 and the second supporting member 120, so the size of the collapsible rack 100 is significantly reduced. As shown in FIG. 3, the thickness of the collapsible rack 100 is approximately the length of the central connector.

The collapsible rack 100 in FIG. 3 can be easily restored by pulling the holding rods 135 and 145 up to their original positions. For example, the collapsible rack 100 can be restored by first lifting the holding rod 135. When the holding rod 135 is lifted, the first and second central connectors 136 and 137 are simultaneously lifted to restore the V-shaped configuration of the connecting rods (131, 133) and (132, 134) to the linear configuration. Meanwhile, the third supporting fabric 153 can be restored and fully extended within the connecting rods (131, 133) and (132, 134), the supporting rod 112 of the first supporting member 110, and the supporting rod 122 of the second supporting member 120. Likewise, when the holding rod 145 is fully lifted, the entire collapsible rack 100 can be restored as shown in FIGS. 1 and 1*a*.

Figure 4:
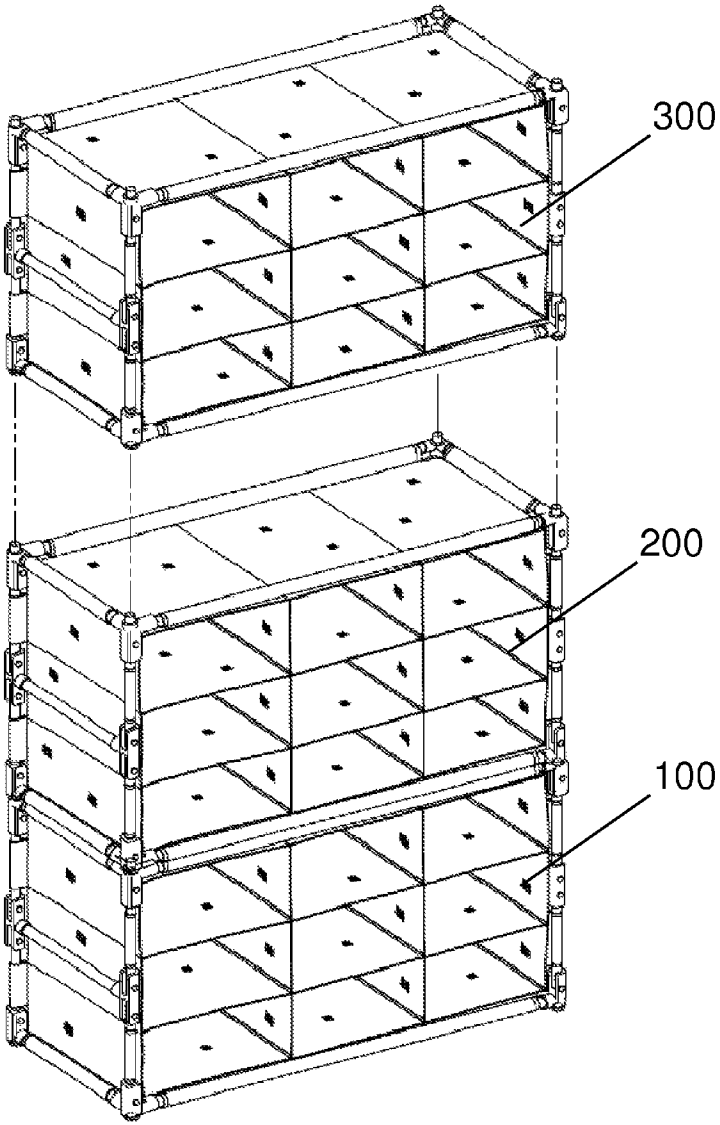
FIG. 4 illustrates a schematic view of the collapsible rack in the present invention, which can be stacked with other racks to increase the storing capacity.
Figure 5:
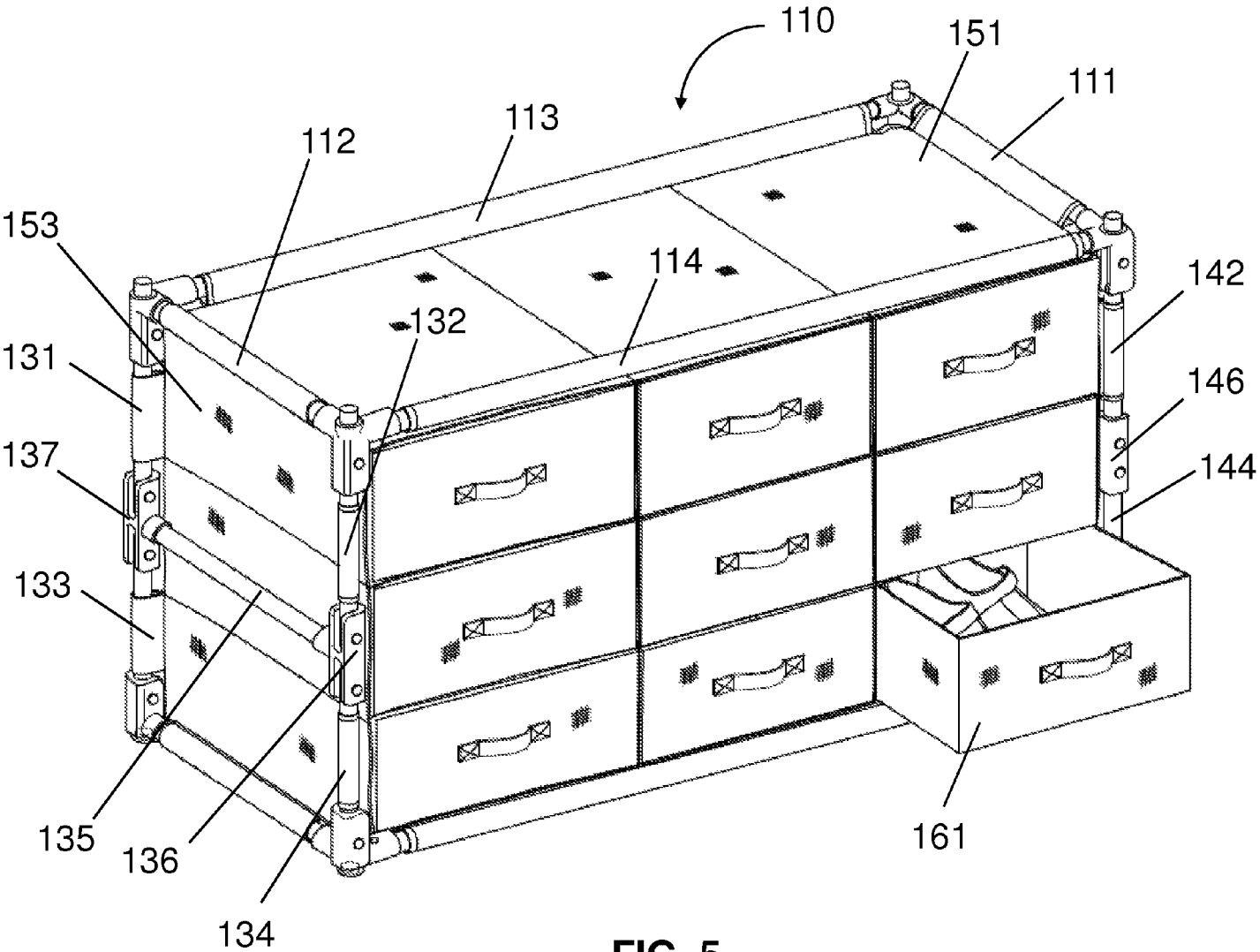
FIG. 5 illustrates a schematic view of another embodiment of the collapsible rack in the present invention.
Figure 6:
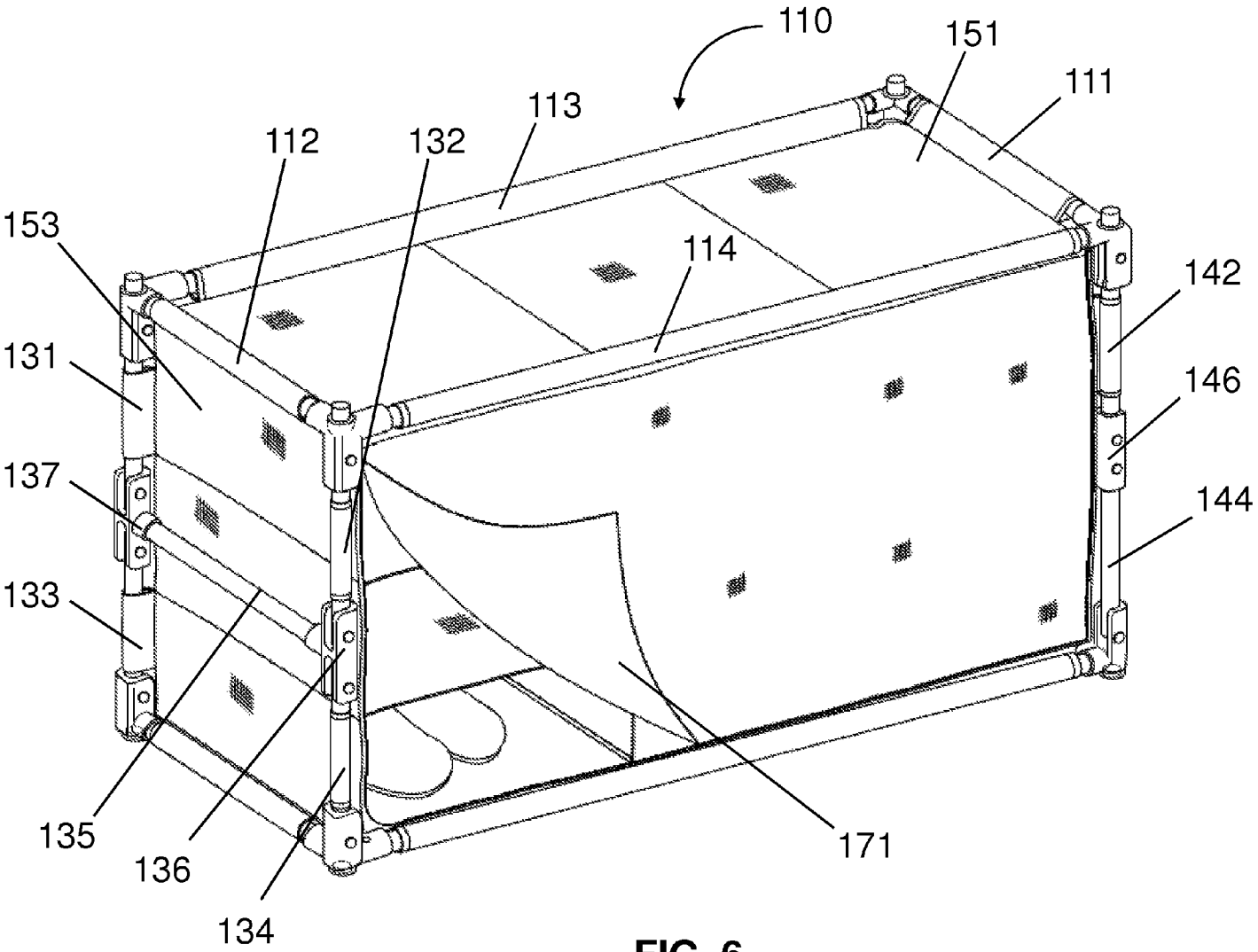
FIG. 6 illustrates a schematic view of a further embodiment of the collapsible rack in the present invention.

In a further embodiment, the collapsible rack 100 can be stacked with at least one other racks (200, 300) as shown in FIG. 4 to increase the storing capabilities. As stated above, the receiving space 150 can be divided by the inner fabric 155 into a plurality of small compartments. In an alternative embodiment, a plurality of drawers 161 can be inserted into the compartments to provide certain level of protection and privacy of the stored objects as shown in FIG. 5. In still a further embodiment, a zipper 171 can be used to cover the receiving space 150 of the collapsible rack 100 as shown in FIG. 6.

Having described the invention by the description and illustrations above, it should be understood that these are exemplary of the invention and are not to be considered as limiting. Accordingly, the invention is not to be considered as limited by the foregoing description, but includes any equivalent.

What is claimed is:

1. A collapsible rack comprising a first supporting member, a second supporting member, a first connecting member and a second connecting member, wherein the first supporting member includes a first pair of supporting rods, a second pair of supporting rods to define a substantially rectangular surface, and the first pair of supporting rods and the second pair of supporting rods are connected with each other through a plurality of connectors, wherein the second supporting member includes a first pair of supporting rods, a second pair of supporting rods to define a substantially rectangular surface, and the first pair of supporting rods and the second pair of supporting rods are connected with each other through a plurality of connectors, wherein the first connecting member includes a plurality of connecting rods, a holding rod, a first central connector, and a second central connector; one end of each connecting rods is pivotally and directly connected to one of the connectors, and the other end thereof is pivotally connected to one of the central connectors; the holding rod, which traverses a substantially central portion of said first connecting member before the rack is collapsed, is secured between two central connectors and substantially perpendicular to the connecting rods of said first connecting member, wherein the second connecting member includes a plurality of connecting rods, a holding rod, a first central connector, and a second central connector; one end of each connecting rods is pivotally and directly connected to one of the connectors, and the other end thereof is pivotally connected to one of the central connectors; the holding rod, which traverses a substantially central portion of said second connecting member before the rack is collapsed, is secured between two central connectors and substantially perpendicular to the connecting rods of said second connecting member, wherein the first supporting member and the second supporting member are disposed in a parallel manner, and spaced and connected by the first connecting member and second connecting member to define a receiving space, and when the holding rod of the first connecting member and the holding rod of the second connecting member are pushed toward the direction of the receiving space, the collapsible rack starts to collapse to reduce the size thereof.

2. The collapsible rack of claim 1, wherein a first supporting fabric is secured by the first supporting member.

3. The collapsible rack of claim 1, wherein a second supporting fabric is secured by the second supporting member.

4. The collapsible rack of claim 1, wherein a third supporting fabric is secured by the first supporting member, and a fourth supporting fabric is secured by the second supporting member.

5. The collapsible rack of claim 4, wherein the receiving space is divided into a plurality of compartment by an inner fabric.

6. The collapsible rack of claim 5, wherein when the holding rods are pushed down, the first and second central connectors are simultaneously moved down with the holding rods to further change the configuration of the connecting rods from linear to V-shaped to collapse the third and fourth supporting fabrics and at least a portion of the inner fabric in the receiving space.

7. The collapsible rack of claim 6, wherein each V-shaped configuration including the central connector coupled with two connecting rods is received between the first supporting member and the second supporting member, so that the size of the collapsible rack is significantly reduced.

8. The collapsible rack of claim 6, wherein the collapsible rack is able to be restored by lifting the holding rods up until the configuration of the connecting rods is restored from V-shaped to linear.

9. The collapsible rack of claim 1, wherein the collapsible rack is stacked with at least one other racks to increase the storing capabilities.

10. The collapsible rack of claim 1, wherein a plurality of drawers are inserted into the compartments of the inner fabric to provide certain level of protection and privacy of stored objects.

11. The collapsible rack of claim 1, wherein a zipper is used to cover the receiving space of the collapsible rack.

* * * * *